US009587886B2

(12) United States Patent
Higashiiue

(10) Patent No.: US 9,587,886 B2
(45) Date of Patent: Mar. 7, 2017

(54) OUTDOOR UNIT AND REFRIGERATION CYCLE DEVICE

(71) Applicant: Mitsubishi Electric Corporation, Tokyo (JP)

(72) Inventor: Shinya Higashiiue, Toyko (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/428,024

(22) PCT Filed: Sep. 27, 2013

(86) PCT No.: PCT/JP2013/076315
§ 371 (c)(1),
(2) Date: Mar. 13, 2015

(87) PCT Pub. No.: WO2014/054533
PCT Pub. Date: Apr. 10, 2014

(65) Prior Publication Data

US 2015/0226489 A1 Aug. 13, 2015

(30) Foreign Application Priority Data

Oct. 5, 2012 (JP) ..... 2012-223017

(51) Int. Cl.
*F28F 13/00* (2006.01)
*F28D 1/04* (2006.01)
(Continued)

(52) U.S. Cl.
CPC ..... *F28D 1/04* (2013.01); *F24F 1/18* (2013.01); *F28D 1/0206* (2013.01);
(Continued)

(58) Field of Classification Search
CPC ..... F28D 1/04; F28D 1/0206; F28D 1/0477; F28D 1/0478; F28D 1/022; F28D 1/32; F28D 2215/04; F24F 1/18
(Continued)

(56) References Cited

U.S. PATENT DOCUMENTS 3,870,485 A * 3/1975 Shiraishi ..... F28C 1/14 239/566
4,186,559 A * 2/1980 Decker ..... F01K 9/026 165/104.26
(Continued)

FOREIGN PATENT DOCUMENTS

JP 46-36309 12/1971
JP 4-116384 A 4/1992
(Continued)

OTHER PUBLICATIONS

International Search Report of the International Searching Authority mailed Dec. 24, 2013 for the corresponding international application No. PCT/JP2013/076315 (and English translation).
(Continued)

*Primary Examiner* — Davis Hwu
(74) *Attorney, Agent, or Firm* — Posz Law Group, PLC

(57) ABSTRACT

An outdoor unit includes an outdoor air heat exchanger formed of an air heat exchanger that includes multiple aligned fins and a heat transfer tube intersecting the fins at multiple positions and transferring heat of a refrigerant flowing in the tube and that exchanges heat between the refrigerant and air; and a blower fan forming a flow of the air flowing through the outdoor air heat exchanger. In the outdoor air heat exchanger, the heat transfer tube intersects the fins at intervals based on a flow rate of the air flowing into the outdoor air heat exchanger according to a positional relationship with the blower fan.

12 Claims, 7 Drawing Sheets

(51) Int. Cl.

| | |
|---|---|
| ***F24F 1/18*** | (2011.01) |
| ***F28F 1/32*** | (2006.01) |
| ***F28D 1/047*** | (2006.01) |
| ***F28F 1/02*** | (2006.01) |
| ***F28D 1/02*** | (2006.01) |

(52) U.S. Cl.
CPC ..... *F28D 1/0477* (2013.01); *F28D 1/0478* (2013.01); *F28F 1/022* (2013.01); *F28F 1/32* (2013.01); *F28F 2215/04* (2013.01)

(58) Field of Classification Search
USPC ..... 165/140, 146, 147
See application file for complete search history.

(56) References Cited

U.S. PATENT DOCUMENTS 5,067,562 A * 11/1991 Ishii ..... F28D 7/08 165/146
2005/0243514 A1* 11/2005 Malone ..... F28D 1/0478 361/697
2008/0053643 A1* 3/2008 Takagi ..... F28F 1/12 165/133
2014/0196874 A1* 7/2014 Miyake ..... F24F 1/16 165/121

FOREIGN PATENT DOCUMENTS

| | | | |
|---|---|---|---|
| JP | 6-18063 | A | 1/1994 |
| JP | 9-145187 | A | 6/1997 |
| JP | 2000-18649 | A | 1/2000 |
| JP | 2000-179893 | A | 6/2000 |
| JP | 2001-336786 | A | 12/2001 |
| JP | 2008-138939 | A | 6/2008 |
| JP | 4430258 | B2 | 12/2009 |
| WO | 2004/083734 | A2 | 9/2004 |

OTHER PUBLICATIONS

Office Action mailed Oct. 29, 2013 for corresponding JP Application No. 2012-223017 (and English translation).

* cited by examiner

VARIATION IN AIR FLOW RATE

VARIATION IN AIR FLOW RATE = (MAXIMUM AIR FLOW RATE - MINIMUM AIR FLOW RATE) / AVERAGE AIR FLOW RATE

OUTDOOR UNIT AND REFRIGERATION CYCLE DEVICE

CROSS REFERENCE TO RELATED APPLICATION

This application is a U.S. national stage application of International Application No. PCT/JP2013/076315 filed on Sep. 27, 2013 and is based on Japanese Patent Application No. 2012-223017 filed on Oct. 5, 2012, the disclosures of which are incorporated by reference.

TECHNICAL FIELD

The present invention relates to an outdoor unit used in a refrigeration cycle device, and the like.

BACKGROUND ART

In some existing refrigeration cycle devices, an outdoor unit includes a single air heat exchanger with multiple (e.g., two) vertically aligned blower devices. In such an outdoor unit, at least in a state where the blower devices operate at high fan rotation speeds (referred to as rotation speed below), setting of the rotation speed of the blower device located above can be switched between a lower speed and a higher speed than that of the blower device located below. By thus making the rotation speeds of the two blower devices different from each other, noise generated by rotation of the two blower devices is reduced (see Patent Literature 1, for example).

CITATION LIST

Patent Literature

Patent Literature 1: Japanese Patent No. 4430258 (FIG. 1)

SUMMARY OF INVENTION

Technical Problem

However, when two blower devices are driven so as to operate at different rotation speeds in such an outdoor unit in which two blower devices are vertically aligned as in Patent Document 1, the pressure in the blower room is unevenly distributed, which causes a phenomenon such as a short cycle or a vortex. Consequently, the air flow rates in the air heat exchanger vary, whereby the performance of the heat exchanger may be reduced, or noise may be increased, for example.

Meanwhile, for example, for the convenience of, for example, the arrangement of components in an outdoor unit, individual areas of the entire heat exchanger do not necessarily have the same distance to blower devices. In such a case, even when the blower devices are driven so as to operate at the same rotation speed, the flow rate of the air flowing into an area located far from the blower devices is low, for example. Consequently, the air flow rates in the air heat exchanger vary, whereby the performance of the air heat exchanger may be decreased.

The present invention has been made to solve the above-described problems and aims to provide an outdoor unit and the like that are capable of reducing variations in the air flow rates in an air heat exchanger.

Solution to Problem

An outdoor unit according to the present invention includes an outdoor air heat exchanger formed of an air heat exchanger, the air heat exchanger including a plurality of aligned fins and a heat transfer tube including a plurality of heat transfer tube segments, the heat exchanger segments intersecting the fins at a plurality of positions and allowing a refrigerant to flow therein, and the air heat exchanger exchanging heat between the refrigerant and air; and a blower device forming a flow of the air flowing through the outdoor air heat exchanger. In the outdoor air heat exchanger, the heat transfer tube intersects the fins at a larger interval in an area of the outdoor air heat exchanger into which air flows at a low air flow rate than an interval in an area of the outdoor air heat exchanger into which air flows at a low air flow rate.

Advantageous Effects of Invention

According to the outdoor unit of the present invention, the heat transfer tube intersects the fins at an interval determined on the basis of the flow rate of the air flowing into the outdoor air heat exchanger according to the positional relationship with the blower device. With this configuration, variations in the air flow rates in the outdoor air heat exchanger can be reduced. This enables a refrigeration cycle device to operate efficiently and save energy, for example.

DESCRIPTION OF EMBODIMENTS

Embodiment 1

Figure 1:
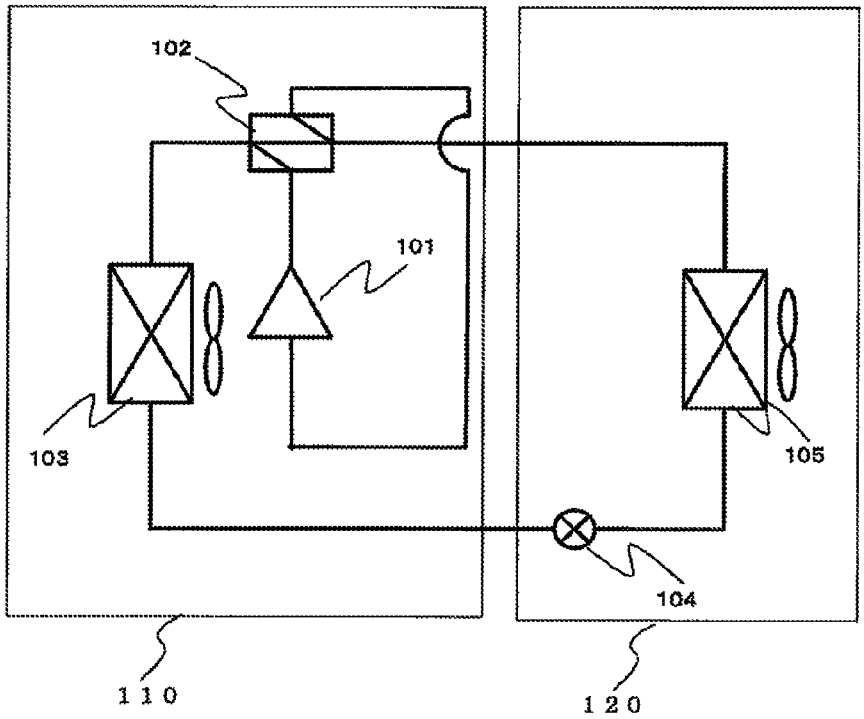
FIG. 1 is a diagram of a configuration of a refrigeration cycle device of Embodiment 1 of the present invention.

FIG. 1 is a diagram illustrating a configuration of a refrigeration cycle device of Embodiment 1 of the present invention. As illustrated in FIG. 1, in Embodiment 1, a refrigerant circuit is formed by connecting a compressor 101, a four-way valve 102, an outdoor air heat exchanger 103, an expansion valve 104, and an indoor air heat exchanger 105, by using refrigerant pipes. The refrigerant circuit is filled with a refrigerant with which the refrigeration cycle device operates. Here, in Embodiment 1, an outdoor unit 110 includes the compressor 101, the four-way valve 102, and the outdoor air heat exchanger 103. Meanwhile, an indoor unit 120 includes the expansion valve 104 and the indoor air heat exchanger 105.

The compressor 101 sucks the refrigerant, compresses the refrigerant so that the refrigerant has a high temperature and a high pressure, and discharges the refrigerant. As the compressor 101 of Embodiment 1, a compressor of a type capable of adjusting the amount of refrigerant to be discharged by controlling the rotation speed with an inverter circuit, for example, may be used. The four-way valve 102 is a valve that switches the flow direction of the refrigerant depending on whether an air-conditioning device, for example, is to perform cooling operation or heating operation. The outdoor air heat exchanger 103 functions as a condenser (radiator) or an evaporator (cooler), for example, and exchanges heat between the refrigerant and air (outdoor air). The outdoor air heat exchanger 103 will be described later.

The expansion valve 104, such as a metering device (flow rate control means), included in the indoor unit 120 decompresses the refrigerant in order to expand the refrigerant. For example, when an electronic expansion valve is used as the expansion valve 104, the opening degree is adjusted according to an instruction from a means such as a control means (not illustrated). The indoor air heat exchanger 105, which serves as a load heat exchanger, exchanges heat between the air (load) targeted for air conditioning, for example, and the refrigerant. In heating operation, the indoor air heat exchanger 105 functions as a condenser (radiator) and heats the air by causing the refrigerant to radiate heat. By contrast, in cooling operation, the indoor air heat exchanger 105 functions as an evaporator (cooler) and cools the air by causing the refrigerant to absorb heat.

Figure 2:
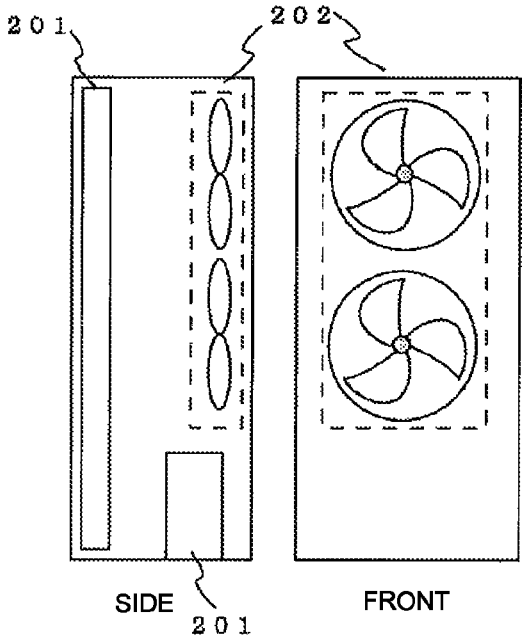
FIG. 2 is a schematic diagram of an arrangement in an outdoor unit 110 according to Embodiment 1 of the present invention.

FIG. 2 is a diagram illustrating an overview of an arrangement in the outdoor unit 110 including the outdoor air heat exchanger 103 according to Embodiment 1 of the present invention. In the outdoor unit 110 of Embodiment 1, an air heat exchanger 201 and multiple blower fans 202 are housed in a casing. In Embodiment 1, the single air heat exchanger 201 is provided as the outdoor air heat exchanger 103 in the refrigerant circuit.

The multiple blower fans 202 vertically aligned (in the vertical direction) are provided in the outdoor unit 110 (casing). The blower fans 202 form a flow of air flowing through the outdoor air heat exchanger 103, in such a way as to promote the heat exchange between the air and the refrigerant in the outdoor air heat exchanger 103. Here, the blower fans 202 are provided in an upper part of the outdoor unit 110 (casing). In addition, an empty space in a lower part is used as a lower space 203. In the lower space 203, a control board that controls the refrigeration cycle device, components, such as the compressor 101, that form the refrigeration cycle device, and the like, for example, are provided.

Figure 3:
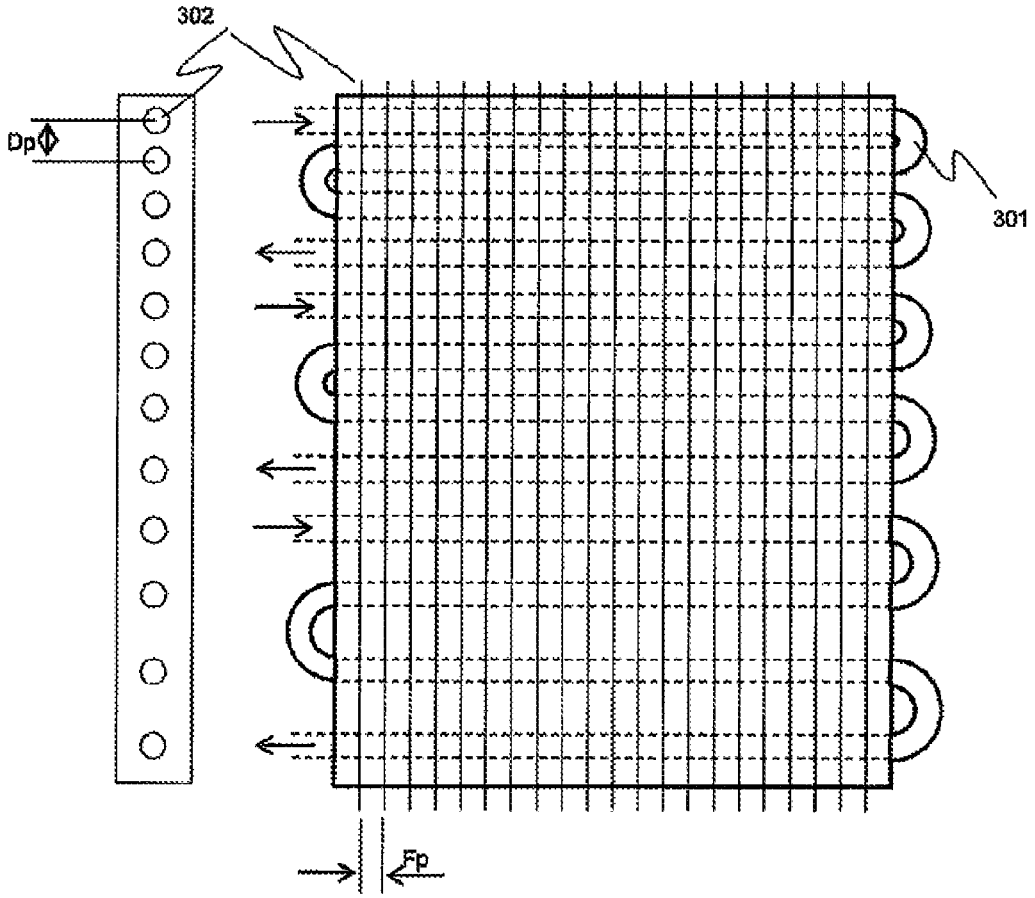
FIG. 3 is a schematic diagram of an outdoor air heat exchanger 103 according to Embodiment 1 of the present invention.

FIG. 3 is a diagram illustrating an overview of the outdoor air heat exchanger 103 according to Embodiment 1 of the present invention. As described above, the outdoor air heat exchanger 103 of Embodiment 1 is formed of the single air heat exchanger 201. Here, the air heat exchanger 201 is a fin and tube heat exchanger including multiple fins 302, which are aligned so that sheets are arranged to be parallel to each other, and a heat exchanger tube including heat transfer tube segments 301, which penetrate through the fins 302 in the direction of the parallel arrangement of the fins 302. The heat transfer tube 301 is a tube that transfers the heat of the refrigerant flowing in the tube to the air flowing outside the pipe. By, for example, bending the heat transfer tube 301 at the sides, the heat transfer tube 301 intersects the fins 302 at multiple positions. In the air heat exchanger 201 of Embodiment 1, the path (air flow path) is split into multiple paths by utilizing the heat transfer tube segments 301. Before flowing into the air heat exchanger 201, the flow of the refrigerant is split by, for example, a distributor, and the refrigerant flows in the individual paths, thereby exchanging heat with the air in the air heat exchanger 201. After flowing out from the air heat exchanger 201, the flows of the refrigerant are recombined. The fins 302 are made from a material such as aluminum, for example, and increase the heat transfer area by being in contact with the heat transfer tube segments 301.

Here, in the outdoor unit 110 of Embodiment 1, the outdoor air heat exchanger 103 (air heat exchanger 201) is placed so that the heat transfer tube segments 301 are vertically aligned. In addition, in the air heat exchanger 201 of Embodiment 1, vertical pitches (intervals) Dp between the intersections of the heat transfer tube segments 301 and the fins 302 are set to increase toward the lower side of the heat transfer tube segments. Meanwhile, the pitches Fp of the fins 302 are the same.

Next, the operation and the like of each of the components of the refrigeration cycle device will be described on the basis of the flow of the refrigerant circulating in the refrigerant circuit. First, a description will be given taking cooling operation as an example. The compressor 101 sucks the refrigerant, compresses the refrigerant so that the refrigerant has a high temperature and a high pressure, and discharges the compressed refrigerant. The discharged refrigerant flows into the outdoor air heat exchanger 103 via the four-way valve 102. The outdoor air heat exchanger 103 exchanges heat between outside air provided by the blower fans 202 and the refrigerant in order to cause the refrigerant to radiate heat and to cool the refrigerant. When appropriate, the refrigerant is condensed and liquefied. The cooled refrigerant flows through the expansion valve 104. The expansion valve 104 decompresses the flowing refrigerant. The decompressed refrigerant flows into the indoor air heat exchanger 105. The indoor air heat exchanger 105 heats the refrigerant by exchanging heat between the refrigerant and indoor air, which is a thermal load (heat exchange target), for example, and evaporates and gasifies the refrigerant. The compressor 101 sucks the evaporated and gasified refrigerant.

Next, a description will be given of heating operation. The compressor 101 sucks the refrigerant, compresses the refrigerant so that the refrigerant has a high temperature and a high pressure, and discharges the compressed refrigerant. The discharged refrigerant flows into the indoor air heat exchanger 105 via the four-way valve 102. The indoor air heat exchanger 105 exchanges heat between the refrigerant and indoor air in order to cause the refrigerant to radiate heat and to cool the refrigerant. The cooled refrigerant flows through the expansion valve 104. The expansion valve 104 decompresses the flowing refrigerant. The decompressed refrigerant flows into the outdoor air heat exchanger 103. The outdoor air heat exchanger 103 exchanges heat between the outside air provided by the blower fans 202 and the refrigerant in order to heat the refrigerant and to evaporate and gasify the refrigerant. The compressor 101 sucks the evaporated and gasified refrigerant via the four-way valve 102.

Next, the operation of the outdoor air heat exchanger 103 will be described. As described above, the flow of the refrigerant is split before the refrigerant flows into the outdoor air heat exchanger 103, and the refrigerant flows into the individual paths of the outdoor air heat exchanger 103. The outdoor air heat exchanger 103 exchanges heat by forced-convention heat transfer between the refrigerant flowing into each path and the air flowing through the outdoor air heat exchanger 103 as a result of rotation of the multiple blower fans 202. Here, all the multiple outdoor air heat exchangers 103 are driven at the same rotation speed.

Each flow rate of the air flowing through the outdoor air heat exchanger 103 is determined according to ventilation resistance when all the other conditions are fixed. For example, in the outdoor air heat excharger 103, the air flow rate is low in an area having a high ventilation resistance while being high in an area having a low ventilation resistance. Here, for example, the multiple blower fans 202 are provided in an upper part of the outdoor unit 110 of Embodiment 1. For this reason, the flow rate of the air flowing into a lower area of the outdoor air heat exchanger 103 is lower than that of the air flowing into an upper area of the outdoor air heat exchanger 103, the upper area being closer than the lower area to the blower fans 202.

Figure 4:
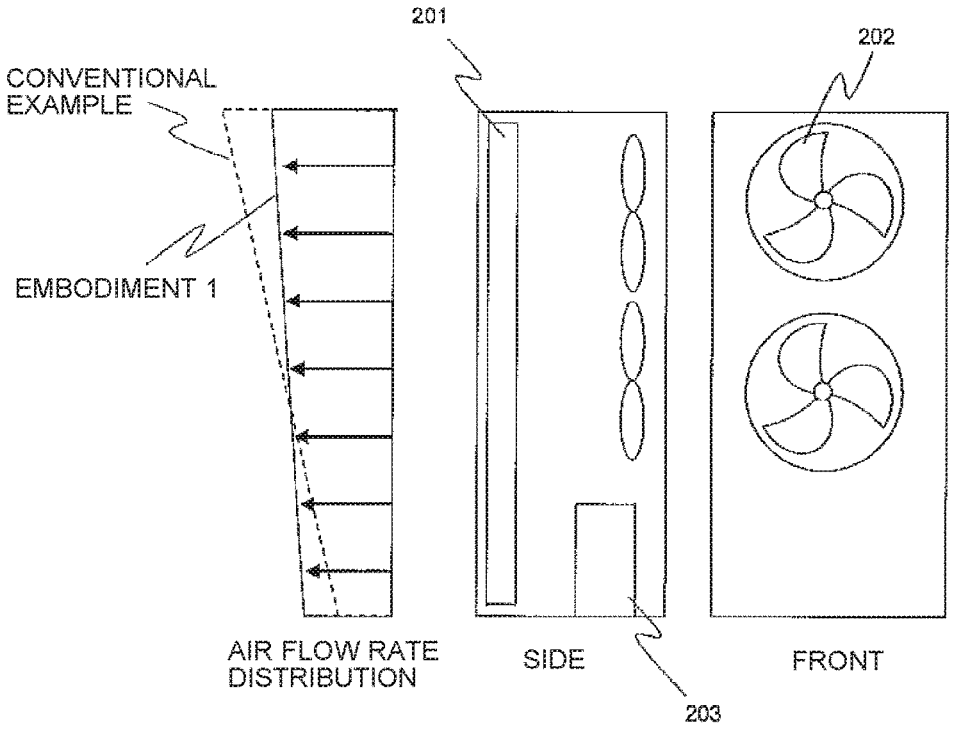
FIG. 4 is a diagram illustrating an overview of a distribution of air flow rates according to the effects of Embodiment 1 of the present invention.

FIG. 4 is a diagram illustrating an overview of a distribution of air flow rates in the outdoor air heat exchanger 103 in Embodiment 1. In Embodiment 1, the lower area of the outdoor air heat exchanger 103 has pitches Dp of the heat transfer tube segments 301 that are larger than those in the upper area in order to make the ventilation resistance lower in the lower area. This allows the flow rate of the air flowing out from the lower area of the outdoor air heat exchanger 103 to be higher than that of the air flowing into the lower area. In this way, variations in the air flow rates in the vertical direction in the outdoor unit 110 can be reduced, which results in uniform air flow rates being obtained. The air flow rate and the air flow rate have a linear relationship, as represented by Equation (1) below. Hence, when the air flow rate increases, the air flow rate increases; when the air flow rate decreases, the air flow rate decreases.

[Equation 1]

$$\text{Air flow rate } (m^3/s) = \text{air flow rate } (m/s) \times \text{area } (m^2) \quad (1)$$

Here, the uppermost pitch Dp of the heat transfer tube segments 301 in the outdoor unit 110 of Embodiment 1 is the same as that of the conventional heat transfer tube segments 301, although not particularly limited to this. Moreover, the pitches are increased gradually in FIG. 4. However, the increase does not need to be gradual. Further, in Embodiment 1, the pitches Dp of the heat transfer tube segments 301 are set to be larger in the lower area than those in the upper area due to the positional relationship between the outdoor air heat exchanger 103 and the blower fans 202. However, the pitches Dp may be determined on the basis of the air flow rates in the outdoor air heat exchanger 103, for example. In addition, this configuration is also applicable to a case in which the number of blower fans 202 is one, or three or more.

Figure 5:
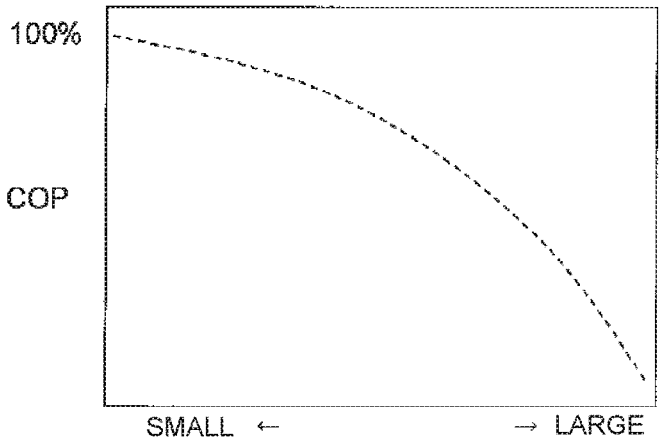
FIG. 5 is a graph representing the coefficient of performance and the variation in air flow rate according to the effects of Embodiment 1 of the present invention.

FIG. 5 is a graph representing the coefficient of performance and the variation in air flow rate according to Embodiment 1 of the present invention. The coefficient of performance (COP) indicates the ratio of performance to power consumption (input) and provides an index of the operation efficiency of the refrigeration cycle device. Next, the effects of the outdoor unit 110 of Embodiment 1 will be described.

As presented in FIG. 5, even in the case where air flows through the outdoor air heat exchanger 103 (air heat exchanger 201) at a fixed total air flow rate, the COP decreases with an increase in the variation of air flow rate when the air flow rates in respective parts of the outdoor air heat exchanger 103 vary. In the outdoor unit 110 of Embodiment 1, the heat transfer tube segments 301 have different pitches Dp so that the outdoor air heat exchanger 103 has different ventilation resistances. With the configuration of the outdoor air heat exchanger 103 in which the ventilation resistance is lower in the area into which air flows at a low flow rate, it is possible to reduce variations in the air flow rates and to maintain a certain COP. Hence, the refrigeration cycle device can operate at high efficiency.

Embodiment 2

The outdoor unit of Embodiment 1 described above has a configuration such that, in the outdoor air heat exchanger 103 formed of the single air heat exchanger 201, the pitches Dp of the heat transfer tube segments 301 gradually increase toward the bottom. With regard to an outdoor unit of Embodiment 2, description will be given of a case in which an outdoor air heat exchanger 103 is formed by connecting heat transfer tube segments 301 of multiple air heat exchangers 201 (formed in such a way as to be divided into multiple blocks, from the view of the outdoor air heat exchanger 103).

Figure 6:
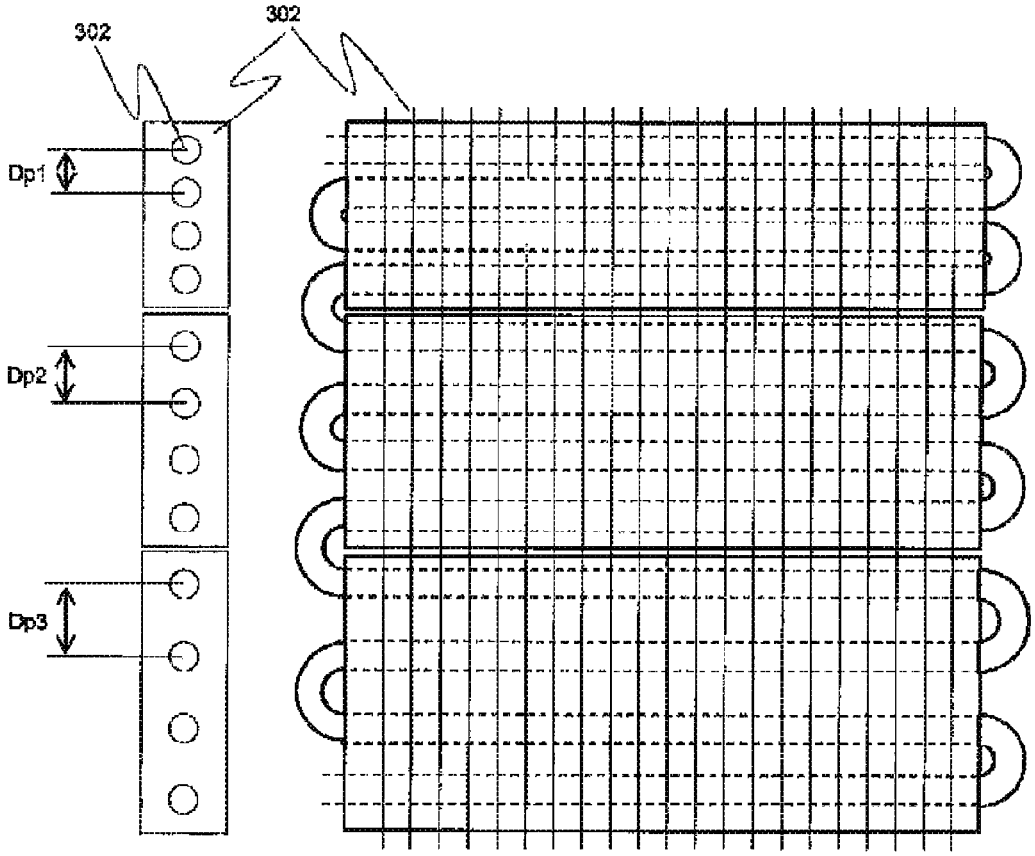
FIG. 6 is a schematic diagram of an outdoor air heat exchanger 103 according to Embodiment 2 of the present invention.

FIG. 6 is a diagram illustrating an overview of the outdoor air heat exchanger 103 according to Embodiment 2 of the present invention. As illustrated in FIG. 6, the outdoor air heat exchanger 103 of Embodiment 2 is formed by connecting the multiple (three in FIG. 6) air heat exchangers 201 with the heat transfer tube segments 301. In other words, the outdoor air heat exchanger 103 is divided into three blocks. Here, the pitches (intervals) of the heat transfer tube segments 301 are different in each of the air heat exchangers 201, and the pitches are denoted by Dp1, Dp2, and Dp3 from the uppermost air heat exchanger 201. The pitches have the following relationship: Dp1<Dp2<Dp3.

Specifically, the pitch Dp2 of the air exchanger tube 301 of the air heat exchanger 201 provided at a lower position among the multiple air heat exchangers 201 included in the outdoor air heat exchanger 103 is set so as to be larger than the pitch Dp1 of the air exchanger tube 301 of the air heat exchanger 201 provided at an upper position. Moreover, the pitch Dp3 of the air exchanger tube 301 of the air heat exchanger 201 provided at a lower position is set so as to be larger than the pitch Dp2 of the air exchanger tube 301 of the air heat exchanger 201 provided at an upper position.

With this configuration, a lower one of the air heat exchangers 201 has a lower ventilation resistance. This allows the flow rate of the air flowing out from the lower area of the outdoor air heat exchanger 103 to be higher than that of the air flowing into the lower area. In this way, variations in the air flow rates in the vertical direction in the outdoor unit 110 can be reduced, which results in uniform air flow rates being obtained. Hence, it is possible to maintain a certain COP and to operate the refrigeration cycle device at high efficiency.

Figure 7:
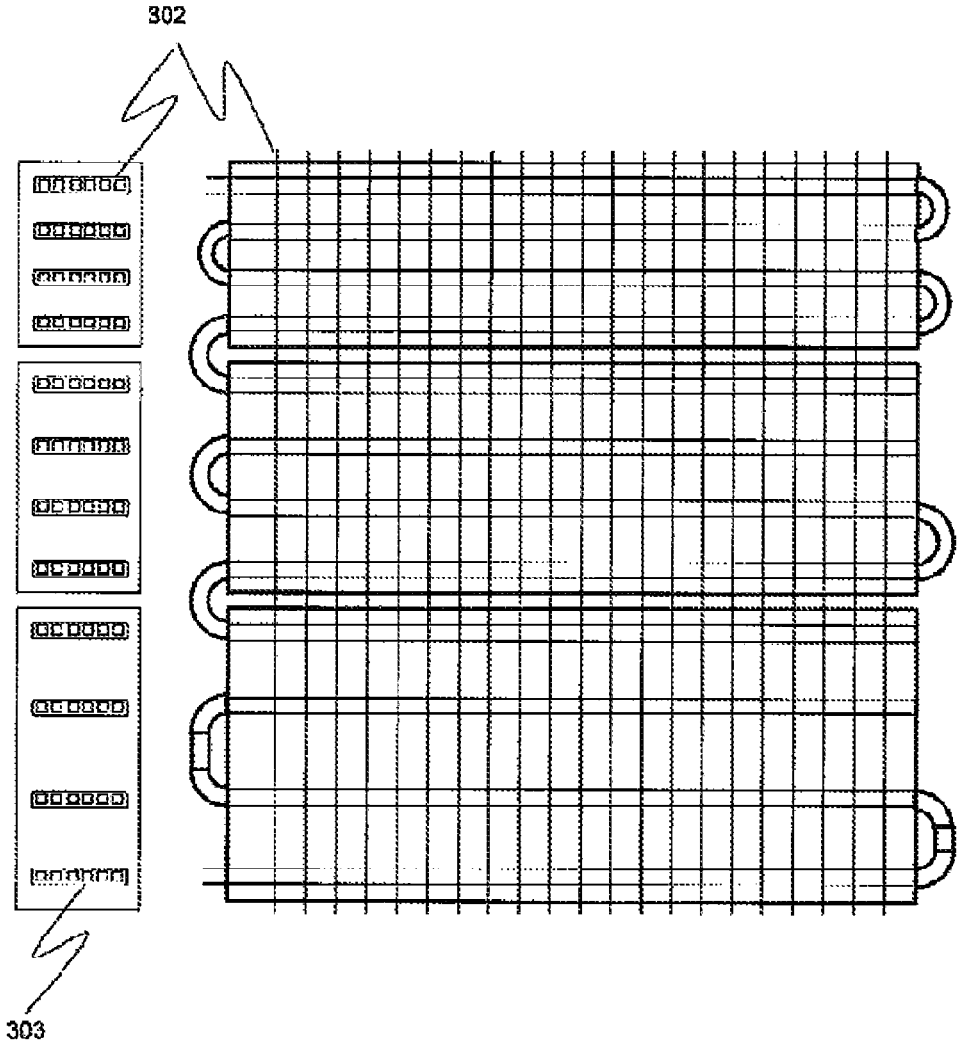
FIG. 7 is a schematic diagram of another example of the outdoor air heat exchanger 103 according to Embodiment 2 of the present invention.

FIG. 7 is a diagram illustrating an overview of another example of the outdoor air heat exchanger 103 according to Embodiment 2 of the present invention. The above-described outdoor air heat exchanger 103 (air heat exchangers 201) in FIG. 6 uses circular pipes as the heat transfer tube segments 301. FIG. 7 illustrates the outdoor air heat exchanger 103 that use flat multi-hole tubes 303 as heat transfer tube segments. As in this example, the same effects can be obtained irrespective of, for example, the shape of the pipes. Alternatively, the flat multi-hole tubes 303 may be used in the outdoor air heat exchanger 103 of Embodiment 1.

Moreover, in FIG. 6 and FIG. 7 described above, the outdoor air heat exchanger 103 includes the three air heat exchangers 201. However, the same effects can be obtained when the number of air heat exchangers 201 included in the outdoor air heat exchanger 103 is two, or four or more.

Embodiment 3

In Embodiment 1 and Embodiment 2 described above, the outdoor air heat exchanger 103 has a configuration such that the pitches Dp of the heat transfer tube segments 301 are set so as to increase toward the bottom. An outdoor unit 110 of Embodiment 3 has a configuration in which the pitches of fins 302 included in an outdoor air heat exchanger 103 (air heat exchangers 201) are different.

Figure 8:
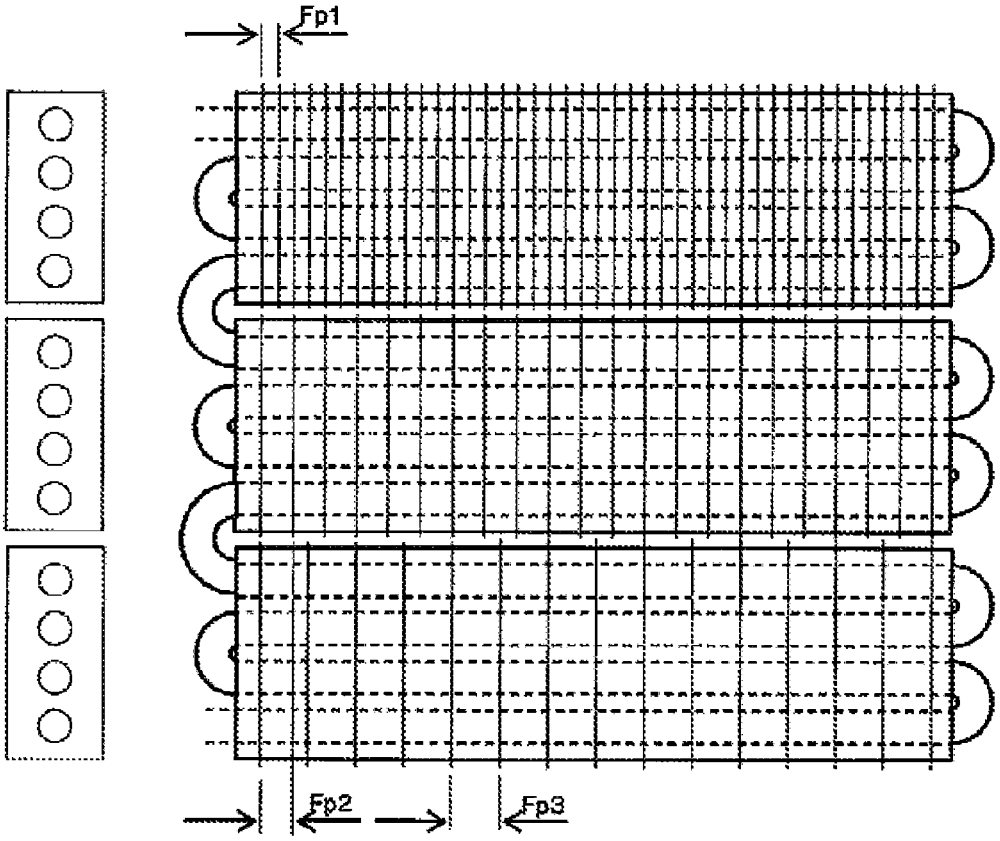
FIG. 8 is a schematic diagram of an outdoor air heat exchanger 103 according to Embodiment 3 of the present invention.

FIG. 8 is a diagram illustrating an overview of the outdoor air heat exchanger 103 according to Embodiment 3 of the present invention. As illustrated in FIG. 8, the outdoor air heat exchanger 103 of Embodiment 3 is formed by connecting multiple (three in FIG. 8) air heat exchangers 201 with a heat transfer tube 301. The pitches of the fins 302 are different in each of the air heat exchangers 201, and the pitches are denoted by Fp1, Fp2, and Fp3 from the uppermost air heat exchanger 201. The pitches have the following relationship: Fp1<Fp2<Fp3.

Specifically, the pitch Fp2 of the fins 302 of the air heat exchanger 201 provided at a lower position among the multiple air heat exchangers 201 included in the outdoor air heat exchanger 103 is set so as to be larger than the pitch Fp1 of the fins 302 of the air heat exchanger 201 provided at an upper position. Moreover, the pitch Fp3 of the fins 302 of the air heat exchanger 201 provided at a lower position is larger than the pitch Fp2 of the fins 302 of the air heat exchanger 201 provided at an upper position.

With this configuration, a lower one of the air heat exchangers 201 has a lower ventilation resistance. This allows the flow rate of the air flowing out from the lower area of the outdoor air heat exchanger 103 to be higher than that of the air flowing into the lower area. In this way, variations in the air flow rates in the vertical direction in the outdoor unit 110 can be reduced, which results in uniform air flow rates being obtained. Hence, it is possible to maintain a certain COP and to operate the refrigeration cycle device at high efficiency.

Moreover, in the outdoor unit 110 of Embodiment 3, fewer fins 302 are needed in the part of the outdoor air heat exchanger 103 where the pitches Fp of the fins 302 are larger than in general. Hence, it is possible to reduce the number of fins and consequently to reduce the manufacturing cost.

Figure 9:
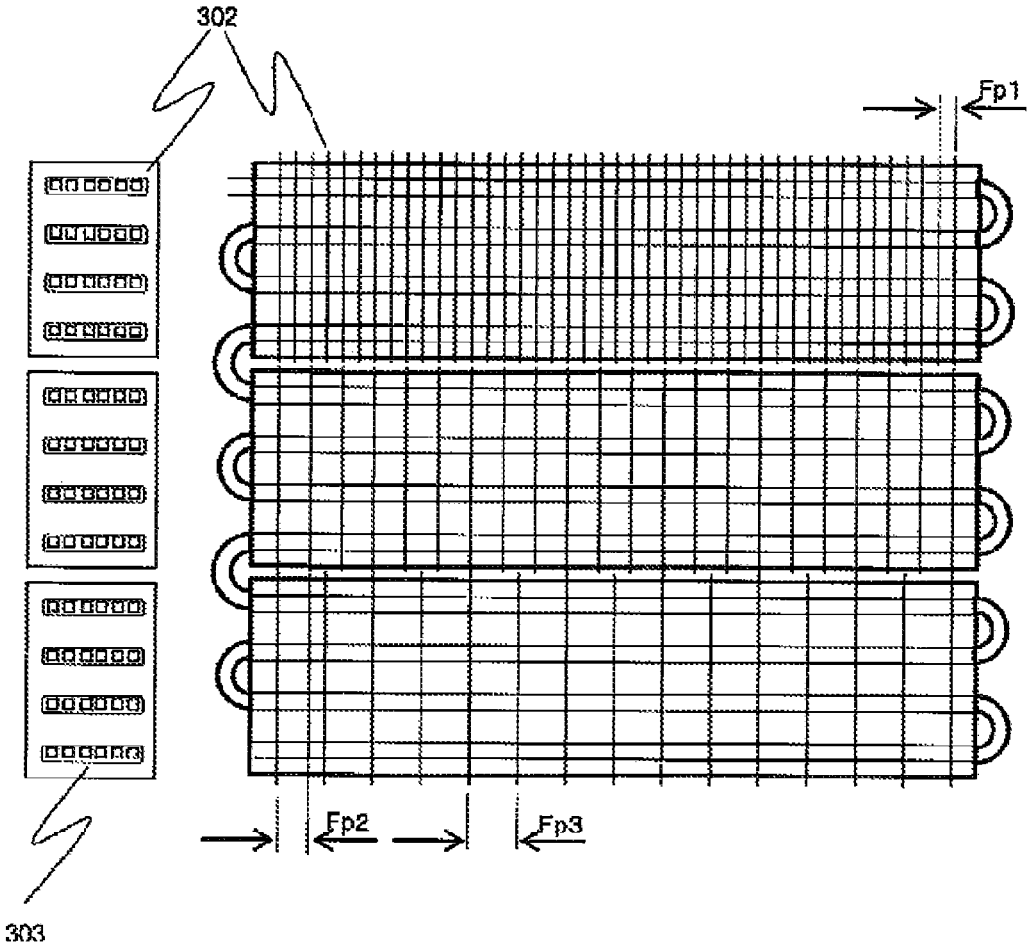
FIG. 9 is a schematic diagram of another example of the outdoor air heat exchanger 103 according to Embodiment 3 of the present invention.

FIG. 9 is a diagram illustrating an overview of another example of the outdoor air heat exchanger 103 according to Embodiment 3 of the present invention. The above-described air heat exchangers 201 in FIG. 8 use circular pipes as the heat transfer tube segments 301. FIG. 9 illustrates a case in which flat multi-hole tubes 303 are used as heat transfer tube segments. As in this example, the same effects can be obtained irrespective of, for example, the shape of the pipes.

Moreover, in FIG. 8 and FIG. 9 described above, the outdoor air heat exchanger 103 includes the three air heat exchangers 201. However, the same effects can be obtained when the number of air heat exchangers 201 included in the outdoor air heat exchanger 103 is two, or four or more.

INDUSTRIAL APPLICABILITY

The present invention is applicable to, for example, the outdoor unit 110 including the outdoor air heat exchanger 103 and the blower fans 202. With the application of the present invention, it is possible to reduce variations in the air flow rates of the entire air heat exchanger and consequently to enhance the efficiency of the refrigeration cycle.

Such a refrigeration cycle device as one described above in Embodiment 1 can be used as a refrigeration cycle device of, for example, an air-conditioning device, a refrigerator, a water heater, or a chiller. Using the outdoor unit according to the present invention enables such a device to operate highly efficiently.

REFERENCE SIGNS LIST

101 compressor 102 four-way valve 103 outdoor air heat exchanger 104 expansion valve 105 indoor air heat exchanger 110 outdoor unit 120 indoor unit 201 air heat exchanger 202 blower fan 203 lower space 301 heat transfer tube 302 fin 303 flat multi-hole tube

The invention claimed is:

1. An outdoor unit comprising:

an outdoor air heat exchanger formed of an air heat exchanger that includes a plurality of aligned fins and a heat transfer tube allowing a refrigerant to flow therein and including a plurality of heat transfer tube segments, the heat transfer tube segments each being formed on the heat transfer tube as being bent and intersecting the fins at a plurality of positions and allowing a refrigerant to flow therein, the heat exchanging heat between the refrigerant and air; and a blower device forming a flow of the air flowing through the outdoor air heat exchanger, wherein, in the outdoor air heat exchanger, intervals between adjacent ones of the heat transfer tube segments being formed on the heat transfer tube as being bent are set to increase toward a region in which a volume of air flowing into the outdoor heat exchanger is large from a region in which the volume of air flowing into the outdoor heat exchanger is small.

2. The outdoor unit of claim 1, wherein the outdoor air heat exchanger includes a plurality of air heat exchangers that are each identical to the air heat exchanger, that are aligned in a direction perpendicular to a direction in which the air flows into the outdoor air heat exchanger, and in which the intervals between adjacent ones of the heat transfer tube segments being formed on the heat transfer tube as being bent vary between the plurality of air heat exchangers.

3. The outdoor unit of claim 1, wherein a plurality of blower devices that are each identical to the blower device are aligned in a vertical direction in an upper part of a casing, and wherein, in the outdoor air heat exchanger, the intervals at which the heat transfer tube segments intersect the fins increase from top to bottom in the vertical direction.

4. The outdoor unit of claim 1, wherein, in the outdoor air heat exchanger, a plurality of air heat exchangers that are each identical to the air heat exchanger and in each of which the fins are arranged at an interval based on a flow rate of air flowing into the air heat exchanger according to a positional relationship with the blower device are aligned in a direction perpendicular to a direction in which the air flows into the outdoor air heat exchanger.

5. The outdoor unit of claim 4, wherein a plurality of blower devices that are each identical to the blower device are aligned in a vertical direction in an upper part of a casing, and wherein, in the outdoor air heat exchanger, the intervals of the fins increases from top to bottom in the vertical direction.

6. The outdoor unit of claim 1, wherein the heat transfer tube is formed of a flat heat exchanger tube.

7. The outdoor unit of claim 3, wherein the plurality of blower devices are driven so as to operate at an identical rotation speed.

8. A refrigeration cycle device comprising:

the outdoor unit of claim 1; and an indoor unit including at least a load heat exchanger, wherein the outdoor unit and the indoor unit are connected with a pipe to form a refrigerant circuit.

9. An outdoor unit comprising:

an outdoor air heat exchanger formed of a plurality of air heat exchangers that include a plurality of aligned fins and a heat transfer tube including a plurality of heat transfer tube segments, the heat transfer tube segments each intersecting the fins at a plurality of positions and allowing a refrigerant to flow therein, the heat exchanger exchanging heat between the refrigerant and air; and a plurality of blower devices forming a flow of the air flowing through the outdoor air heat exchanger, the plurality of blower devices are aligned in a vertical direction in an upper part of a casing, wherein intervals between the heat transfer tube segments in the outdoor air heat exchanger are set to increase toward a region in which a volume of air flowing into the outdoor heat exchanger is large from a region in which the volume of air flowing into the outdoor heat exchanger is small, the fins of the plurality of air heat exchangers in the outdoor air heat exchanger are arranged at intervals based on a flow rate of air flowing into the air heat exchanger according to a positional relationship with the blower device are aligned in a direction perpendicular to a direction in which the air flows into the outdoor air heat exchanger, and the intervals of the fins in the outdoor air heat exchanger increases from top to bottom in the vertical direction.

10. The outdoor unit of claim 1, wherein each of the heat transfer tube segments are bent heat transfer tube segments that include a bent tube connector that connects two parallel tubes.

11. The outdoor unit of claim 10, wherein the intervals span between each of the bent heat transfer tube segments.

12. The outdoor unit of claim 1, wherein the outdoor air heat exchanger is an air condition system outdoor air heat exchanger, and the blower is an air condition system blower.

* * * * *